United States Patent [19]

Fasano

[11] 3,944,220

[45] Mar. 16, 1976

[54] GLOVE AND HAND EXERCISER

[75] Inventor: Thomas Fasano, Freehold, N.J.

[73] Assignee: Lawrence Peska Associates, Inc., New York, N.Y. ; a part interest

[22] Filed: Feb. 27, 1975

[21] Appl. No.: 553,741

[52] U.S. Cl. ..... 272/67; 2/159

[51] Int. Cl.[2] ..... A63B 5/00

[58] Field of Search ..... 84/465; 2/159, 161 A, 168; 272/67, 80, 82

[56] References Cited

UNITED STATES PATENTS

| | | | |
|---|---|---|---|
| 2,108,236 | 2/1938 | Scott | 272/67 |
| 3,333,850 | 8/1967 | Miller | 2/161 A |

*Primary Examiner*—Jerome Schnall

[57] ABSTRACT

A glove hand exerciser containing longitudinal stiffening inserts adapted to create and apply tension when the finger and/or hand muscles are flexed thereby exercising the muscles.

5 Claims, 3 Drawing Figures

GLOVE AND HAND EXERCISER

BACKGROUND OF THE INVENTION

This invention relates to an exerciser for the hand and forearm muscles, more particularly to an exerciser in the form of a glove which is cosmetically acceptable yet at the same time is useful for the purpose for which the same is intended.

The prior art teaches a variety of hand exercising devices, such as for example the complicated, cumbersome and unsightly devices set forth in U.S. Pat. Nos.: 494,197; 897,471; and 3,347,547; all of which devices are obviously not suitable for wearing in public and furthermore are quite complex to set up upon the hand. U.S. Pat. No. 2,736,034 while not as unsightly is of a different character than the aforementioned group in that it relates only to a finger weight-containing glove and not to a full hand muscle exercising device. U.S. Pat. No. 2,108,236, is quite similar to the aforesaid patent, differing only in that there is a mitten and the tips of the fingers therein are provided with panels having varying resiliency thereby controlling the up and down movement of the fingers, as desired.

In contradistinction thereto, the instant invention provides for a gloved device, having finger stalls, and running longitudinally with the fingers, along the inner surface of the glove, into the stall, there are provided a plurality of straps operative to be tightened at the wrist such that the relative movement of each finger is separately adjustable.

SUMMARY OF THE INVENTION

It is accordingly an object of the instant invention to avoid one or more drawbacks of the prior art.

It is another object to provide for a cosmetically and fashionably acceptable glove which at the same time functions as a hand exerciser, if desired.

It is a further object of the invention to provide for such a glove that is relatively simply and inexpensively constructed.

These and other objects of the invention will become more apparent from the following detailed disclosure and claims, and in the accompanying drawing, in which:

Figure 1:
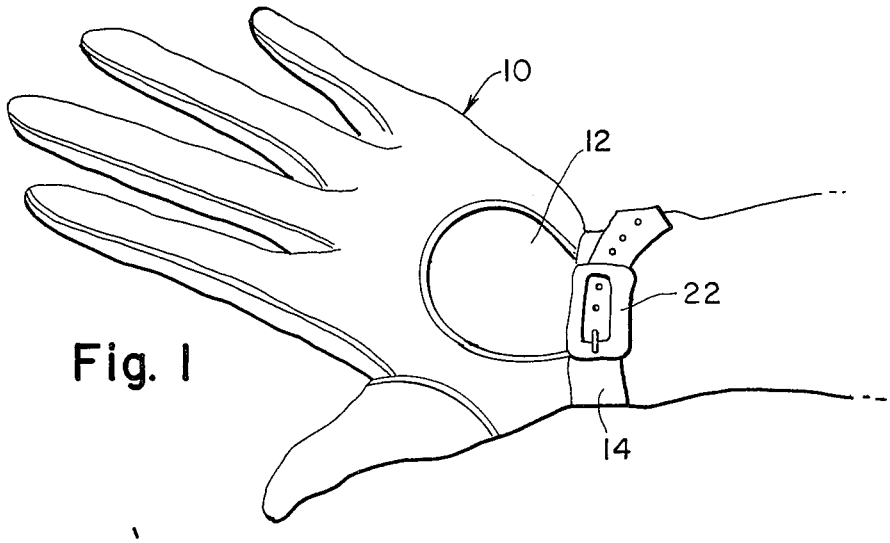
FIG. 1 is a top plan view of an embodiment of a glove on a hand.
Figure 2:
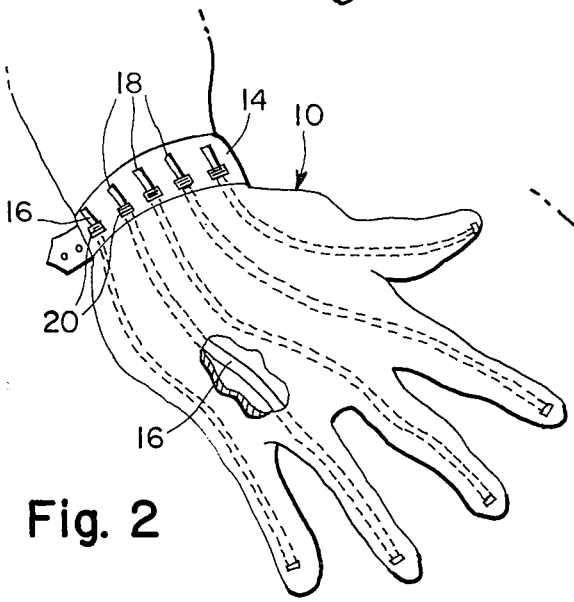
FIG. 2 is a perspective view palm up.
Figure 3:
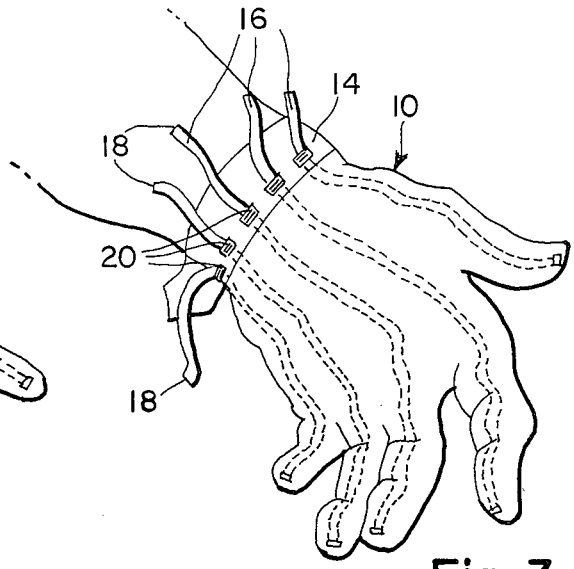
FIG. 3 is similar to FIG. 2 but shows the tensioning straps in a taut position.

Broadly speaking, the invention includes the provision of a finger and hand exercising glove comprising a glove defining finger stalls and a wrist area, tension straps disposed on the glove, each of the straps communicating between a single finger stall and the wrist area of the glove, the straps having two end portions, a first end portion being fixedly engaged by a portion of said finger stall, a second end being free, holding means disposed at the wrist area of the glove, the holding means being adapted to slidably engage the free end of the strap, the strap being operative to slide inwardly and outwardly in the holding means whereby movement of the strap exerts restraint upon the finger stall.

DETAILED DESCRIPTION

Referring more particularly to the drawing, where like numerals designate like elements, there is shown a glove 10, having finger stalls, palm down, on a hand 12.

The glove 10 has a wrist strap 14 or wrist band to facilitate movement of tensioning straps 16. The straps 16 are positioned, preferably on the inner surface of the glove 10 and will be placed along the palm area and if desired can also be placed along the back hand area; the straps 16 will run in the longitudinal direction of the fingers such that each one strap 16 will enter a finger stall; the straps 16 can be arranged such that each finger stall receives one, as is the preferred embodiment. The straps 16 will generally be fabricated of a leather or leather-like material, even certain resiliant plastics, such that tension may be applied thereto for drawing the same taut or relaxing the same. The drawing or relaxing of each strap 16 affecting the relative movement of the finger to which stall the same is connected and thence the hand muscles therealong. It is to be understood that one to five fingers may be exercised, each finger stall being independent of the others. The straps 16 will be suitably fastened to the inner surface of each finger stall, preferably between the inner surface of the glove material and a glove lining. Fastening can be accomplished by any suitable means, such as by rivets, stitching or the like. Each strap 16 will preferably have an elongated shape and will have one free end 18, each free end 18 will be adapted to be engaged by a single or plurality of holding means 20 which means 20 is adapted to allow for slidable movement of the strap 16 therethrough. The holding means 20 can be in the form of a ringlet or a tightly pulled elastic material defining an opening through which the free end 18 of the strap 16 is inserted. In order to draw the strap 16 taut or relax the same, the strap 16 is merely slidably moved through the holding means 20. The holding means 20 in the preferred embodiment will be disposed on a wrist portion of the glove 10. The wrist portion 14 can be unitary with the body of the glove 10 or affixed thereto, such as in the form of a wrist band 14 attached to the body of the glove 10. It is preferable that the wrist portion 14 have a buckle means 22 to facilitate holding the glove 10 on the hand, especially when the straps 16 are drawn taut. If desired, additional means may be provided at the wrist area to lock the straps 16 in place and prevent any slippage thereof.

While the invention has been described with reference to the embodiments shown in the drawings, it is to be understood that various modifications and changes will be apparent to those skilled in the art; all of which are intended to be within the purview of the invention.

Having herein described the invention, what I claim is:

1. A finger and hand exercising glove comprising a glove body having an inner and outer surface and defining finger stalls, and a wrist area, elastic tension straps disposed on said glove, each of said straps communicating between a single finger stall and a wrist area of said glove, each strap operative to move independent of said other straps, said straps each having two end portions, a first end portion being fixedly engaged by a portion of said finger stall, a second end being free, holding means disposed at said wrist area of said glove, said holding means being adapted to slidably engage said free end of each of said straps, each of said straps being operative to slide inwardly and outwardly in said holding means whereby movement of each of said straps exerts independent restraint upon a single finger stall.

2. A glove as defined in claim 1, wherein said straps are disposed on the inner surface of said glove.

3. A glove as defined in claim 1, wherein there are a plurality of holding means.

4. A glove as defined in claim 1, wherein said wrist area contains buckle means adapted to fixedly engage said glove on said hand.

5. A glove as defined in claim 1, wherein said wrist area is unitary with the remainder of said glove.

* * * * *